United States Patent [19]

Garcia

[11] 4,031,345

[45] June 21, 1977

[54] MINIATURE ELECTRICAL SWITCH

[75] Inventor: Ricardo L. Garcia, Justice, Ill.

[73] Assignee: Grayhill, Inc., LaGrange, Ill.

[22] Filed: Nov. 26, 1975

[21] Appl. No.: 635,652

Related U.S. Application Data

[63] Continuation-in-part of Ser. No. 533,882, Dec. 18, 1974, Pat. No. 3,958,090.

[52] U.S. Cl. ..... 200/67 AA; 200/5 A; 200/6 R; 200/16 C; 200/153 LA; 200/277; 200/DIG. 29

[51] Int. Cl.[2] ..... H01H 13/28

[58] Field of Search ..... 200/5 A, 5 B, 6 R, 6 B, 200/6 BB, 8 R, 11 J, 11 K, 16 R, 16 C, 16 D, 29, 50 C, 51 R, 61.59, 65.67 R, 67 A, 67 AA, 68, 69, 74, 75, 76, 77, 88, 100 R, 144, 153 L, 153 LA, 153 G, 153 A, 153 J, 154, 235, 287, 275, 277, 287, 293, 303, 332, 333, 336, DIG. 29

[56] References Cited

UNITED STATES PATENTS

| | | | |
|---|---|---|---|
| 1,131,129 | 3/1915 | Gordon | 200/76 |
| 1,412,002 | 4/1922 | Hendricks, Jr. | 200/8 R |
| 2,246,373 | 6/1941 | Lodge | 200/16 C |
| 2,817,722 | 12/1957 | Johnson | 200/11 J |
| 2,927,185 | 3/1960 | Bonnaire | 200/67 AA |
| 2,960,580 | 11/1960 | Aquillon | 200/6 BB |
| 3,032,620 | 5/1962 | Siiberg | 200/67 R |
| 3,878,388 | 4/1975 | Lockard | 200/6 B |
| 3,958,090 | 5/1976 | Garcia | 200/67 AA |
| 3,971,903 | 7/1976 | Wilentchik | 200/16 C |
| 3,978,298 | 8/1976 | Fukuda | 200/6 R |

FOREIGN PATENTS OR APPLICATIONS

| | | | |
|---|---|---|---|
| 1,150,430 | 8/1957 | France | 200/67 AA |
| 561,004 | 5/1944 | United Kingdom | 200/67 AA |

OTHER PUBLICATIONS

AMP Product Information Bulletin, *Switches and Relays*, 3 pp., No. 4294–5, No. 4295–5, No. 4296–5, Feb. 1975.

AMP Inc., *Switches and Relays*, data sheet No. 74–249, 2 pp. issued July 1974.

*Primary Examiner*—Volodymyr Y. Mayewsky
*Attorney, Agent, or Firm*—Lockwood, Dewey, Zickert & Alex

[57] ABSTRACT

A miniature electrical switch including a housing having a cover and a base plate and a switching assembly within the housing. The switching assembly includes a switch actuator, a ball contactor and a spring, together with a contact assembly. A plurality of contacts are engageable by the ball contactor to electrically interconnect contacts connected to a circuit. The contacts are arranged to enable the switch to be used in single-pole double-throw, double-pole double-throw or multiple-pole double-throw modes.

21 Claims, 12 Drawing Figures

FIG. 1
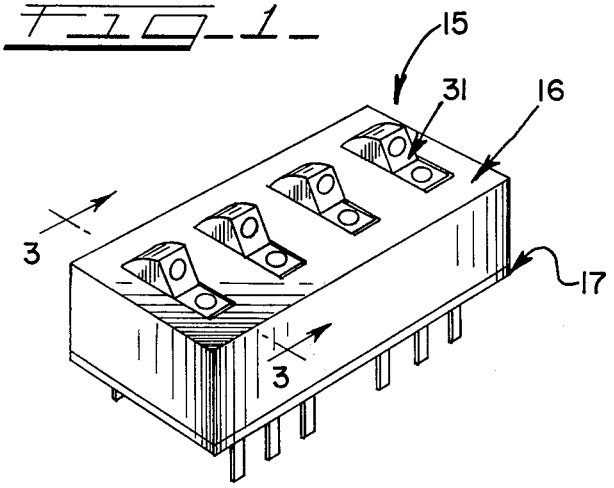
FIG. 3
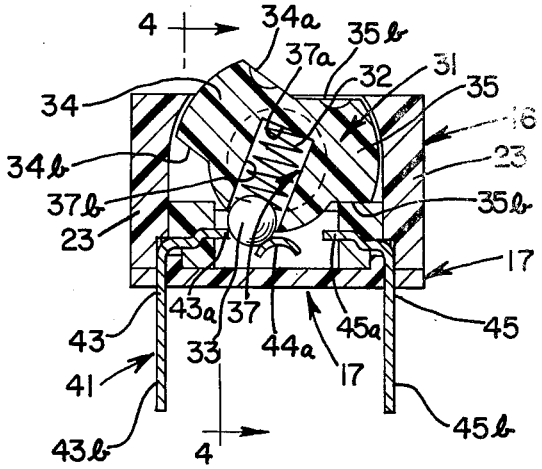
FIG. 4
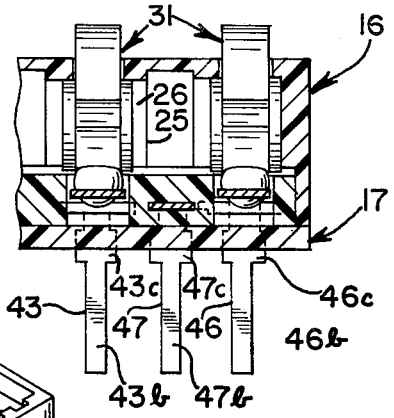
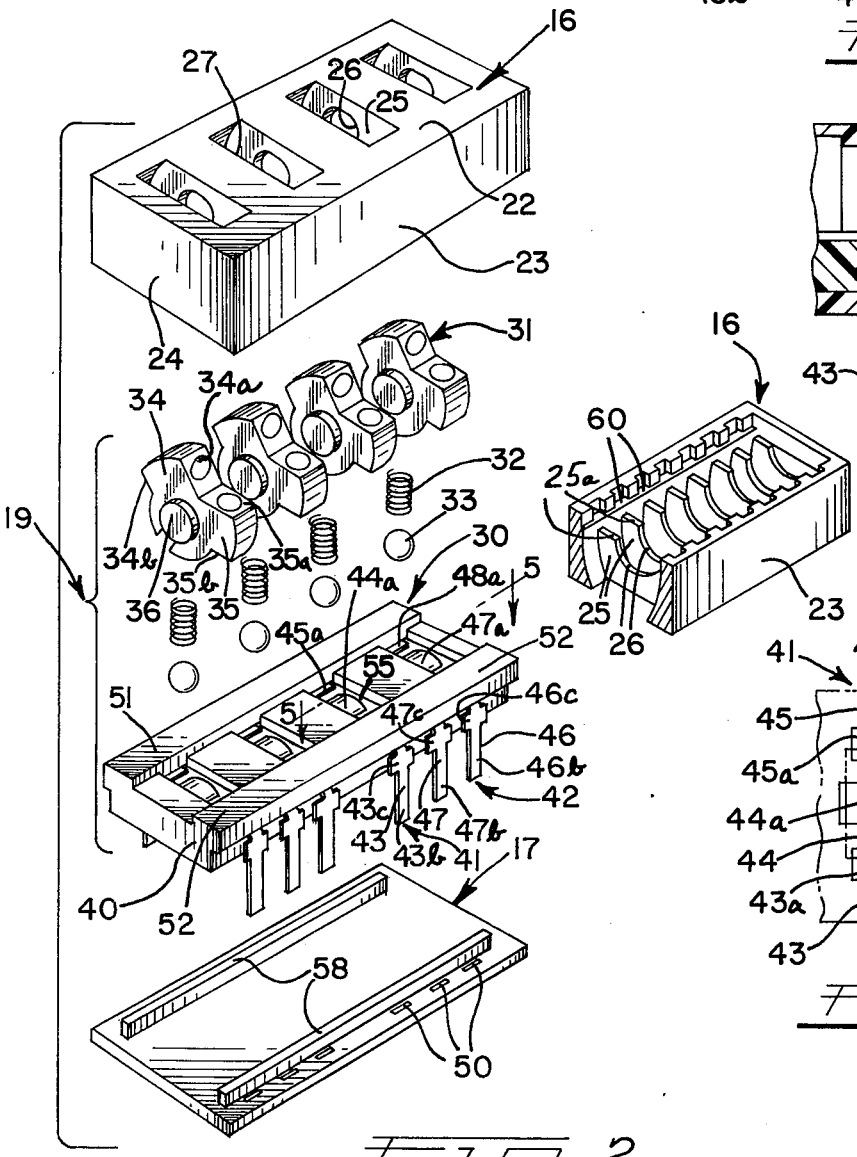
FIG. 2
FIG. 6
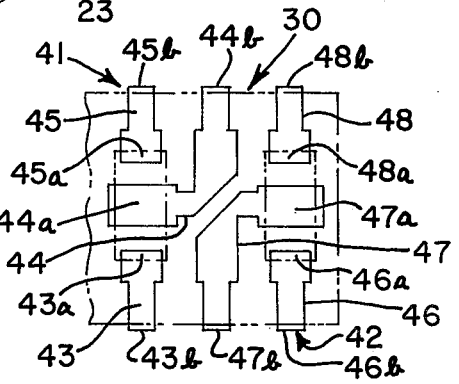
FIG. 5

FIG. 7
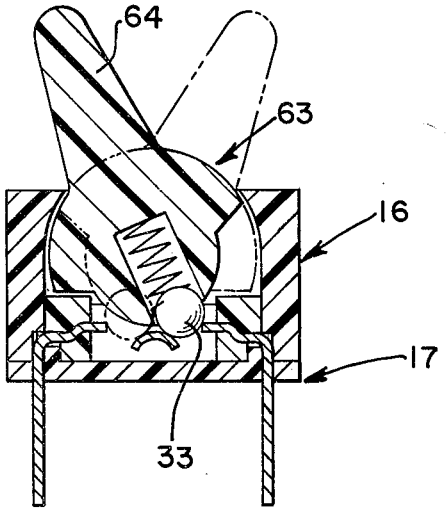
FIG. 9
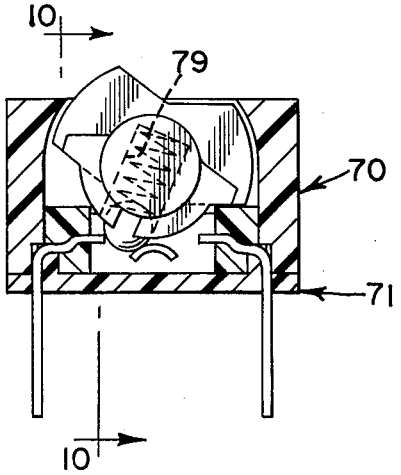
FIG. 8
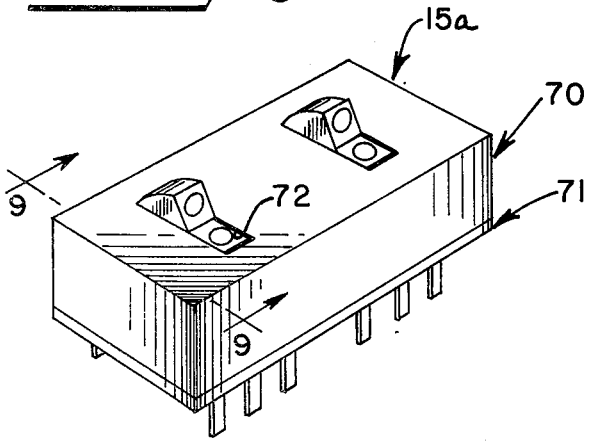
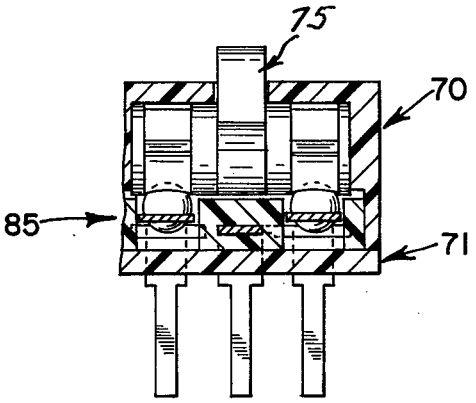
FIG. 10
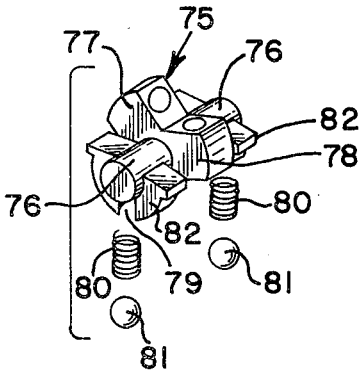
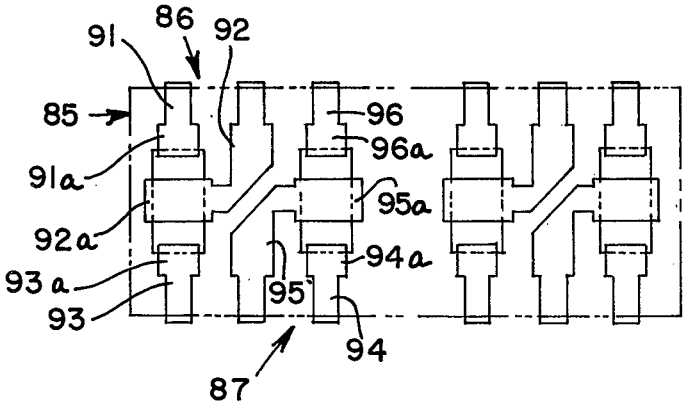
FIG. 11
FIG. 12

MINIATURE ELECTRICAL SWITCH

This application is a continuation-in-part application of copending application Ser. No. 533,882 filed Dec. 18, 1974 now U.S. Pat. No. 3,958,090.

This invention relates in general to a miniature electrical switch for use in printed circuit board applications, and more particularly to a miniature electrical switch capable of providing single-pole double-throw, double-pole double-throw and multiple-pole double-throw modes.

Electronic equipment utilizing printed circuitry often requires manual programming. The miniature electrical switch in my copending application provides single-pole single-throw switching mode, while the miniature switch in this application is capable of providing either single-pole double-throw or double-pole double-throw modes, both of which can be used in multiples or multiple-pole double-throw mode. Accordingly, these switches are miniaturized and especially useful for manual programming of data processing, communications, and panel and logic applications.

Heretofore, there have been miniature switches for printed circuitry applications such as one which includes overlapping contacts that when forced together close a circuit in response to movement of an actuator. This switch has been objectionable since it did not provide tease-proof reliability which is necessary in order to obtain a sufficiently satisfactory life span. Moreover, such heretofore known miniature switches have not provided a proper degree of positive switching action.

The switch of the present invention includes a ball contactor movable between spaced contacts for making electrical connection between the contacts and which overcomes the objections heretofore known in miniature switching assemblies wherein absolute positive action is always obtained. While it has been known to provide ball contactor switches, such as in U.S. Pats. Nos. 1,131,129, 1,412,002, 2,246,373 and 2,927,185, it has not been known to provide a miniature switch like that of the present invention having the positive switching control and tease-proof reliability demanded in present-day printed circuitry applications.

The miniature switch of the present invention in one embodiment provides single-pole double-throw mode, while in another embodiment provides double-pole double-throw mode, and still further in another embodiment multiple-pole double-throw mode. In the first embodiment, each switch actuator coacts with a spring and ball contactor to selectively position the ball contactor between a first and second contact or the second and a third contact. Two sets of three contacts are provided for the switch embodiment of the double-pole double-throw mode, wherein an actuator drives two ball contactors, one for each set of switch contacts. The manner in which the actuator drives the ball contactors and the relationship with the contacts provides the degree of positive control needed for printed circuitry applications.

It is therefore an object of the present invention to provide a new and improved miniature electrical switch for use in printed circuitry which provides tease-proof reliability and positive control in switching action.

Another object of this invention is in the provision of a miniature electrical switch having the ability to withstand normal shock and vibration and capable of long cycle life.

A still further object of this invention is to provide a miniature electrical switch for printed circuitry capable of providing single-pole double-throw and double-pole double-throw modes.

Other objects, features and advantages of the invention will be apparent from the following detailed disclosure, taken in conjunction with the accompanying sheets of drawings, wherein like reference numerals refer to like parts, in which:

FIG. 1 is a perspective view of a miniature electrical switch according to the invention;

FIG. 2 is an exploded perspective view of the switch in FIG. 1;

FIG. 3 is an enlarged vertical transverse cross-sectional view taken substantially along line 3—3 of FIG. 1;

FIG. 4 is an enlarged fragmentary vertical sectional view taken substantially along line 4—4 of FIG. 3;

FIG. 5 is an enlarged top plan fragmentary view of the terminals from the contact assembly taken generally along line 5—5 of FIG. 2 and illustrating the outline in dotted of the terminal support frame;

FIG. 6 is a perspective view of the inside of the cover with some parts broken away for purposes of clarity;

FIG. 7 is a view similar to FIG. 3 but showing a modification where a toggle is utilized as a switch actuator instead of a rocker;

FIG. 8 is a perspective view of a modified switch according to the invention capable of double-pole double-throw mode;

FIG. 9 is an enlarged vertical transverse sectional view taken substantially along line 9—9 of FIG. 8;

FIG. 10 is a fragmentary enlarged vertical longitudinal sectional view taken substantially along line 10—10 of FIG. 9;

FIG. 11 is a perspective view of the switch actuator for the switch of FIG. 8 removed from the housing and also showing in exploded form the ball contactors and springs therefor; and FIG. 12 is a top plan view of the terminals of the contact assembly for the switch of FIG. 8 and showing the terminal support frame in phantom.

Referring now to the drawings and particularly to the embodiment of FIGS. 1 to 5, the minature electrical switch, generally designated by the numeral 15, includes a housing having a cover 16 and a base plate 17. A switching assembly, generally designated by the numeral 19, is mounted within the housing, although it will be appreciated that portions of terminals from the switch assembly extend through the base plate and to the exterior of the housing, while portions of the switch actuators extend or protrude from the housing to provide access for operation. When the switch is assembled and the switching assembly is arranged within the housing, the base plate 17 is suitably secured to the cover, such as by ultrasonic welding, and coacts with the cover 16 to maintain the switching assembly in position. Further, the base plate quite importantly functions to prevent contaminants from entering the housing and contaminating the switching assembly. It should be appreciated here such contaminants are encountered during soldering terminals to a printed circuit board and thereafter cleaning the board. Accordingly, the housing is completely closed, there being openings only in the base plate for terminals and openings in the cover for the switch actuators.

The cover 16 is generally rectangular in shape and includes a top wall 22, opposed side walls 23, and opposed end walls 24. Both the cover and the base plate are constructed of electrical insulating material such as a suitable plastic material that may be injection-molded. Extending between the side walls 23 and integrally formed therewith, as shown particularly in FIGS. 2 and 6, is a bearing means for the switch actuators in the form of a plurality of longitudinally equally spaced apart partitions 25 having generally arcuately formed notches 26. As seen in FIG. 2, each adjacent pair of bearing partitions 25 coacts with a switch actuator opening 27 formed in the top wall 22 of the cover.

The switching assembly 19 shown in FIG. 2 includes generally a contact assembly 30, a plurality of switch actuators 31, together with biasing means in the form of coil springs 32 and ball contactors 33 for the switch actuators. The switch actuators 31 are also of electrical insulating material and may be injection-molded of a suitable plastic, while the ball contactor is of a suitable electrically conductive material, such as a metal. The switch actuators 31 are in the form of rockers and include a main body defined by a pair or rocker arms 34 and 35, opposed stub shafts 36, and a recess 37. The rocker arms are associated with the stub shafts such that they are arranged angularly with respect to each other so that pivotal movement of the switch actuator can be obtained by applying pressure against one or the other of the rocker arms 34 and 35. The rocker arms include outwardly exposed faces **34*a* and 35*a* against which pressure may be applied during operation of the actuator and stop faces 34*b* and 35*b* which coact with the contact assembly 30 in a manner that will be more clearly explained hereafter wherein pivotal movement of the switch actuator is limited in its opposite positions. The recess 37 in each switch actuator is in the form of a blind bore having an end wall 37*a* and a cylindrical side wall 37*b*. As seen in FIG. 3, the coil spring 32 bottoms at one end on the recess and wall 37*a* and engages at the other end the ball contactor 33. It may be also noted that a portion of the ball contactor is received within the recess 37 wherein movement of the switch actuator causes respective movement of the coil spring and ball contactor associated therewith. The stub shafts 36 coact with the arcuately formed notches 26 of the bearing partitions 25 which not only position the actuators within the housing cover but also serve to pivotally mount the actuators therein. As seen in FIG. 3, the openings 27 in the top wall of the cover have a width equal to the width of the rocker arms of the switch actuator and a length less than the greatest longitudinal dimension of the rocker arms so that the switch actuator fits snugly and provides the least amount of opening with respect to the cover through which foreign matter may enter for contaminating the switch contacts. Accordingly, the opposite stub shafts 36 ride in the bearing notches 26** of the cover.

The contact assembly 30 includes a terminal support member or frame 40 of electrical insulating material and a plurality of sets of terminals, and illustrative are two sets of terminals 41 and 42 shown in FIG. 5. Each set of terminals includes respectively first, second and third contact portions. More specifically, the set of terminals 41 includes terminals 43, 44 and 45, while the set of terminals 42 includes terminals 46, 47 and 48. The terminals in turn include contact portions **43*a*, 44*a*, 45*a*, 46*a*, 47*a* and 48*a*, and conductor connection portions 43*b*, 44*b*, 45*b*, 46*b*, 47*b*, and 48*b*. It should be appreciated that the sets of terminals 41 and 42 are described as being those at the right-hand end of the contact assembly, as seen in FIG. 2, and that the sets of terminals at the left-hand end will be identical. The switch of this modification provides single-pole double-throw mode and therefore requires three terminals. It should be further recognized that any number of sets of terminals together with respective actuators, springs and ball contactors may be provided in a single switch, there being four shown in the embodiment of FIGS. 1 to 5** for explanation of the invention.

The sets of terminals are of a suitable conductive material and are integrally molded in the terminal support member 40. As seen in the drawings, the conductor connection portions of the terminals extend through holes 50 formed in the base plate 17 for exposure to the outside of the housing. The terminal support member 40 is rectangularly formed and sized to fit snugly within the housing cover 16, as shown in FIGS. 3 and 4. Further, the terminal support member is formed in relation to the terminals such that the base plate 17 coacts snugly with the frame when the switch is in completely assembled relation, as seen in FIGS. 3 and 4. More specifically, the terminal support member 40 includes upper longitudinally extending stop bars 51 and 52 which coact with the stop faces **34*b* and 35*b* of the switch actuator rocker arms for limiting pivotal movement of the switch actuators. The terminal support member so supports each terminal in spaced relation, thereby electrically insulating the terminals from each other. Each set of terminals exposes the contact portions to engagement by a ball contactor by virtue of the construction of the terminal support member. Opposed transversely extending guide ways 55** are defined by the frame member for each set of terminal contactor portions and between which the ball contactor for that set of contact portions moves.

As seen most clearly in FIG. 3, where the set of terminals will be designated by the numeral 41, the center contact portion **44*a* is arcuately formed to permit ease of movement of the ball contactor 33 thereacross when the switch actuator is being moved from one position to the other. The opposed contact portions 43*a* and 45*a* of terminals 43 and 45 coact with the central contact portion 44*a* to define a spacing therebetween less than the diameter of the ball contactor. Further, the contact portions 43*a* and 45*a* coact with the contact portion 43*a* to define areas into which the ball contactor may be resiliently biased and positively fitted to provide positive control of the actuators relative to the two switching positions they can attain. A detent action is accordingly obtained during movement of the switch actuator from the position where the ball contactor engages contact portions 43*a* and 44*a* to the other position where the ball contactor would engage contact portions 44*a* and 45*a*. The ball contactor moves along a path that is perpendicular to the axis of rotation of the switch actuator and the arcuate formation of the center contact portion 44*a*** is such as to prevent the possible hang-up of the ball contactor thereon during its traverse from one position to the other position.

It will be appreciated that when the switch is in assembled relation, the action of the coil spring forces the ball contactor in one direction against contact portions of the terminals and the switch actuator in the opposite direction into bearing engagement with the bearing notches of the cover. Accordingly, all of the elements of the switching assembly are maintained in proper position at all times.

The base plate 17 includes a pair of parallel spaced ribs 58 on the side facing the cover and which interfit between the conductor connecting portion or leg of each terminal and the base portion of the terminal support member 40, as shown particularly in FIG. 3. The side of the base plate facing the cover also bears directly against the undersurface of the terminal support member 40, as shown in FIG. 3, to assist in maintaining the contact assembly 30 in the proper location within the housing and to cause the stop bars 51 and 52 to seat on the edges 25*a* of the partitions 25.

To additionally positively locate and fit the contact assembly 30 within the cover, notches 60 are formed on the cover, as seen particularly in FIG. 6, for receiving the portions of the terminals at the bend area between the contact portions and the conductor connecting portions and guiding them into proper place, as shown in FIG. 3. Further the coaction between the notches and the terminals functions to prevent contaminants from engaging the movable parts. Enlargements 43*c*, 47*c* and 46*c* are formed adjacent the bend in the terminals and which fit into the slots or openings 50 in the base plate 17. As already mentioned, the base plate 17, when in position on the cover 16, is suitably secured thereto such as by an ultrasonic welding process or the like.

The embodiment of FIG. 7 differs from the embodiment of FIGS. 1 to 6 only in that the switch actuator, generally designated by the numeral 63, is in the form of a toggle instead of a rocker, wherein a toggle arm 64 is engaged for actuation of the switch. It should be appreciated that one switch could have a combination of rocker type actuators or toggle type actuators if desired and that the operation of the switch would be identical. Further, the primary elements of the switch, including the cover, the contact assembly, the ball contactors and springs, are identical to the switch in the embodiment of FIGS. 1 to 6.

It may be here appreciated that the switch illustrated in FIGS. 1 to 7 relates to a single-pole double-throw and that any number of switching assemblies may be provided in a single switch housing.

The embodiment of FIGS. 8 to 12 differs from the embodiment of FIGS. 1 to 7 primarily in that the structure of the actuator is such as to control simultaneous operation of a pair of ball contactors engaging two sets of terminals so that the switch may be operated in a double-pole double throw or multiple-pole double-throw mode. It can be appreciated that the connection of the six terminals will be such as to provide the double-pole double-throw mode. More specifically, the central contact portions of each set of terminals would be connected in common, while the outer contact portions of each set of terminals would be respectively connected to separate circuits.

As already mentioned, the overall structure of the switch in the embodiment of FIGS. 8 to 12 which will provide double-pole double-throw mode, designated generally by the numeral 15A, includes many parts which are identical to the structure of the switch in the embodiment of FIGS. 1 to 7. The housing includes generally a cover 70 and a base plate 71. The cover 70 differs from the cover 16 only in that the number of switch actuator openings 72 in the top wall of the cover would be one half as many provided in the cover 16, where the outside dimensions of the switch are the same. Of course, the number of actuators would also be one half in number. For example, there are four single-pole double-throw mode switching assemblies in the embodiment of FIG. 1, while there are two double-pole double-throw mode switching assemblies in the embodiment of FIG. 8. Any number of switching assemblies may be provided in a housing by increasing or decreasing the length of the housing and otherwise increasing or decreasing the number of openings in the cover, the length of the cover and base plate, the number of terminal holes or slots in the base plate, and the number of sets of terminals on the contact assembly together with the number of switch actuators. While the switch actuators in the embodiment of FIGS. 8 to 12 are shown to be of the rocker type, it should be appreciated they may be of the toggle type illustrated in FIG. 7.

The switch 15A includes switch actuators 75 which differ from the switch actuators 31 of the embodiment of FIG. 1 in that the stub shafts 76 extending from the rocker arms 77 and 78 are longer than the stub shafts 36 of the actuator 31. Further, the actuator 75 includes a pair of recesses 79, one on each side of the rocker arms in longitudinal spaced relation for receiving coil springs 80 and ball contactors 81. The recesses are positioned radially of the stub shafts and in alignment along the same radius or diameter so that the ball contactors move together along the same radius during movement of the actuator between its two positions.

It will be understood the cover 70 will include the same internal structuring as the cover of the embodiment of FIG. 1. In this respect, there will be the same number of bearing partitions and notches for the same size cover and the same number of terminal receiving notches. In this respect, the stub shafts 76 will be bearingly supported by four bearing notches. The rocker arms 77 and 78 will be received between two adjacent bearing partitions and the outer enlarged guide portions 82 in alignment with the recesses 79 will also be received between the pair of adjacent bearing partitions. One of the bearing partitions for each of the outer guide portions will be common with that receiving the rocker arms 77 and 78, as can be appreciated in FIGS. 10 and 11. Accordingly, the switch actuator is maintained against lateral shifting in the cover by the bearing partitions and the portion of the switch actuator which protrudes through the actuator opening 72 in the cover. It will also be noted here that the guide portions 82 as well as the rocker arms 77 and 78 provide stop faces for coacting with the stop faces on the contact assembly to limit the pivotal movement of the actuator.

The contact assembly 85 for this embodiment is identical to the contact assembly 30, and for purposes of explaining the operation of the double-pole double-throw mode, reference is made to FIG. 12, which shows the contact assembly 85 on one end having a set of terminals 86 and a set of terminals 87 which will coact with a single switch actuator having a pair of ball contactors for providing the double-pole double-throw mode. The set of terminals 86 includes terminals 91, 92 and 93, while the set of terminals 87 includes terminals 94, 95 and 96. Respectively, the terminals 91, 92 and 93 include contact portions 91*a*, 92*a* and 93*a*, all aligned along a path or axis transverse the pivotal axis of the actuator. Similarly, the terminals 94, 95 and 96 provide contact portions 94*a*, 95*a* and 96*a* for a single switch actuator. The ball contactors 81 will thereby respectively engage the contact portions of sets of terminals 86 and 87, as seen in FIG. 10. Accordingly, in one position, the ball contactors will respectively engage contact portions 92*a*–93*a* and contact portions 95*a*–94*a*, while in the other position they will respectively engage contact portions 91*a*–92*a* and contact portions 96*a* –95*a*. With the terminals 92 and 95 connected in common, the terminals 91 and 96 connected into one circuit, and the terminals 93 and 94 connected into another circuit, double-pole double-throw mode is accomplished. Moreover, these six terminals could be connected into four circuits to provide multiple-pole double-throw mode where two circuits would be closed in one position and the other two circuits would be closed in the other position.

It will be understood that modifications and variations may be effected without departing from the scope of the novel concepts of the present invention, but it is understood that this application is to be limited only by the scope of the appended claims.

The invention is hereby claimed as follows:

1. A miniature electrical switch for controlling the operation of circuit means comprising, a housing of electrical insulating material, said housing including a cover and a base plate, said cover being generally rectangular in shape and having a top wall, opposed side and end walls and defining an opening opposite the top wall, and switching means within the housing which includes a contact assembly, a switch actuator, a biasing means and an electrically conductive ball contactor, wherein said switch actuator, biasing means and ball contactor move together between first and second switch positions relative said contact assembly, said base plate being sized to close the opening opposite the top wall and retain said switching means within the housing, said cover having bearing means for pivotally mounting said actuator therein and an opening in one wall through which a part of the actuator protrudes for access to operate same, said actuator having a recess for receiving said biasing means and said ball contactor, said recess having an end wall, whereby said biasing means seats at one end on the recess end wall and the ball contactor engages the other end thereof, said contact assembly including a terminal support member of electrical insulating material and a set of firsts, second and third electrically conductive members, each conductive member having a contact portion and a conductor connection portion, said contact portions being spaced apart along a line transverse the pivot axis of the actuator and in alignment with the path of movement of the ball contactor for engagement therewith, and said conductor connection portions extending through holes in said base plate to the exterior of the housing, and said biasing means urging said actuator into seated position in the bearing means and said contactor into engagement with said contact portions, said contact portions being arranged to cause positive positioning of the contactor with said first and second contact portions or said second and third contact portions thereby causing positive positioning of said actuator and electrical connection between said first and second contact portions or said second and third contact portions.

2. The combination as defined in claim 1, wherein said actuator and said terminal support member of the contact assembly include means for limiting the pivotal movement of the actuator.

3. The combination as defined in claim 1, wherein said biasing means comprises a coil spring.

4. The combination as defined in claim 1, wherein said switch includes a plurality of switching means and coating contact assemblies.

5. The combination as defined in claim 1, wherein said switching means includes an actuator coacting with a plurality of biasing means and ball contactors, and a plurality of contact assemblies one for each ball contactor.

6. The combination as defined in claim 1, wherein said switching means includes an actuator coacting with a pair of biasing means and ball contactors, and a plurality of contact assemblies one for each ball contactor so that the contact assemblies can be connected to provide a double-pole double-throw mode.

7. The combination as defined in claim 1, wherein said actuator is a rocker.

8. The combination as defined in claim 1, wherein said actuator is a toggle.

9. A miniature electrical switch for controlling the operation of circuit means comprising, a housing of electrical insulating material, said housing including a cover and a base plate, said cover being generally rectangular in shape and having a top wall, opposed side end walls and defining an opening opposite the top wall, and switching means within the housing which includes a contact assembly, a plurality of switch actuators, a plurality of biasing means and a plurality of electrically conductive ball contactors, wherein one of said switch actuators, biasing means and ball contactors move together between first and second switch positions relative the contact assembly, said base plate being sized to close the opening opposite the top wall and retain said switching means within the housing, said cover having a plurality of bearing means for pivotally mounting said actuators therein in juxtaposed position and openings in one wall through which a part of each actuator protrudes for access to operate same, each said actuator having a recess for receiving a biasing means and a ball contactor, each said recess having an end wall, whereby each said biasing means seats on one end on a recess end wall and a ball contactor engages the other end thereof, said contact assembly including a terminal support member of electrical insulating material and a plurality of sets of first, second and third electrically conductive members, each conductive member having a contact portion and a conductor connection portion, said contact portions of each set being spaced apart along a line transverse the pivot axes of the actuator for said set and in alignment with the path of movement of the ball contactor therefor for engagement therewith, and the conductor connection portions of each set extending through holes in said base plate to the exterior of the housing, and the biasing means for each actuator urging same into seated position in a bearing means and the contactor therefor into engagement with a set of contact portions, said contact portions being arranged to cause positive positioning of the contactor with said first the second contact portions or said second and third contact portions thereby causing positive positioning of said actuator and electrical connection between said first and second contact portions or said second and third contact portions.

10. The combination as defined in claim 9, wherein each said actuator and said terminal support member of the contact assembly include means for limiting the pivotal movement of each actuator.

11. The combination as defined in claim 9, wherein each said acutator is a rocker.

12. The combination as defined in claim 9, wherein each said actuator is a toggle.

13. A miniature electrical switch for controlling the operation of circuit means comprising, a housing of electrical insulating material, said housing including a cover and a base plate, said cover being generally rectangular in shape and having a top wall, opposed side and end walls and defining an opening opposite the top wall, and switching means within the housing which includes a contact assembly, a switch actuator, a pair of biasing means and a pair of electrically conductive ball conductors, wherein said switch actuator, biasing means and ball contactors move together between first and second switch positions relative said contact assembly, said base plate being sized to close the opening opposite the top wall and retain said switching means within the housing, said cover having bearing means for pivotally mounting said actuator therein and an opening in one wall through which a part of the actuator protrudes for access to operate same, said actuator having a pair of spaced recesses each receiving a biasing means and a ball contactor, each recess having an end wall whereby the biasing means therefor seats at one end on the recess end wall and the ball contactor therefor engages the other end thereof, said contact assembly including a terminal support member of electrical insulating material and a pair of sets of first, second and third electrically conductive members, each conductive member having a contact portion and a conductor connection portion, said contact portions of each said set being spaced apart along a line transverse the pivot axis of the actuator and in alignment with the path of movement of one of said ball contactors for engagement therewith, and said conductor connection portions extending through holes in said base plate to the exterior of the housing, and both said biasing means urging said actuator into seated position in the bearing means and both said actuators into respective engagement with the contact portions of each said set, said contact portions being arranged to cause positive positioning of the contactors respectively with said first and second contact portions or said second and third contact portions of a set thereby causing positive positioning of said actuator and electrical connection between said first and second contact portions or said second and third contact portions of each said set.

14. The combination as defined in claim 13, wherein said actuator and said terminal support member of the contact assembly include means for limiting the pivotal movement of said actuator.

15. The combination as defined in claim 13, wherein said actuator is a rocker.

16. The combination as defined in claim 13, wherein said actuator is a toggle.

17. A miniature electrical switch for controlling the operation of circuit means comprising, a housing of electrical insulating material, said housing including a cover and a base plate, said cover being generally rectangular in shape and having a top wall, opposed side and end walls and defining an opening opposite the top wall, and switching means within the housing which includes a contact assembly, a plurality of switch actuators, a pair of biasing means a pair of electrically conductive ball contactors for each said switch actuator, wherein each said switch actuator, respective biasing means and ball contactors move together between first and second switch positions relative said contact assembly, said base plate being sized to close the opening opposite the top wall and retain said switching means within the housing, said cover having a plurality of bearing means for pivotally mounting said acuators therein in juxtaposed position and openings in one wall through which a part of each actuator protrudes for access to operate same, each said actuator having a pair of spaced recesses each receiving a biasing means and a ball contactor, each recess having an end wall whereby the biasing means therefor seats at one end on the recess end wall and the ball contactor therefor engages the other end thereof, said contact assembly including a terminal support member of electrical insulating material and a pair of sets of first, second and third electrically conductive members for each actuator, each conductive member having a contact portion and a conductor connection portion, said contact portions of each said set being spaced apart along a line transverse thepivot axis of the actuator and in alignment with the path of movement of one of said ball contactors for engagement therewith, and said conductor connection portions extending portion holes in said base plate to the exterior of the housing, and both said biasing means for each said actuator urging said actuator into seated position in the bearing means and both said contactors therefor into respective engagement with the contact portions of a set, said contact portions being arranged to cause positive positioning of the contactors respectively with said first and second contact portions or said second and third contact portions of a set thereby causing positive positioning of said actuator and electrical connection between said first and second contact portions or said second and third contact portions of each said set.

18. The combination as defined in claim 17, wherein each said actuator and said terminal support member of the contact assembly include means for limiting the pivotal movement of each actuator.

19. The combination as defined in claim 17, wherein each said actuator is a rocker.

20. The combination as defined in claim 17, wherein each said actuator is a toggle.

21. A miniature electrical switch for controlling the operation of circuit means comprising, a housing of electrical insulating material, said housing being generally rectangular in shape and having a top wall, opposed side and end walls and defining an opening opposite the top wall, and switching means within the housing which includes a contact assembly, a switch actuator, a biasing means and an electrically conductive ball contactor, wherein said switch actuator, biasing means and ball contactor move together between first and second switch positions relative said contact assembly, said housing having bearing means therein for pivotally mounting said acutator therein and an opening in one wall through which a part of the actuator protrudes for access to operate same, said actuator having a recess for receiving said biasing means and said ball contactor, said recess having an end wall, whereby said biasing means seats at one end on the recess end wall and the ball contactor engages the other end thereof, said contact assembly including a terminal support member of electrical insulating material and a set of first, second and third electrically conductive members, each conductive member having a contact portion and a conductor connection portion, said contact portions being spaced apart along a line transverse the pivot axis of the actuator and in alignment with the path of movement of the ball contactor for engagement therewith, and said biasing means urging said actuator into seated position in the bearing means and said contactor into engagement with said contact portions, said contact portions being arranged to cause positive positioning of the contactor with said first and second contact portions or said second and third contact portions thereby causing positive positioning of said actuator and electrical connection between said first and second contact portions or said second and third contact portions.

* * * * *

UNITED STATES PATENT AND TRADEMARK OFFICE

CERTIFICATE OF CORRECTION

PATENT NO. : 4,031,345

DATED : June 21, 1977

INVENTOR(S) : Ricardo L. Garcia

It is certified that error appears in the above-identified patent and that said Letters Patent are hereby corrected as shown below:

Col. 3, line 35, change "opposite" to --opposed--;
Col. 8, line 11, change "coating" to --coacting--; and
Col. 10, line 48, change "thepivot" to --the pivot--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*